United States Patent [19]

Granger

[11] Patent Number: 5,035,356

[45] Date of Patent: Jul. 30, 1991

[54] MAILBOX COVER STRUCTURE

[76] Inventor: Ray L. Granger, P.O. Box 416, Siren, Wis. 54872

[21] Appl. No.: 566,059

[22] Filed: Aug. 13, 1990

[51] Int. Cl.[5] ..... B65D 91/00

[52] U.S. Cl. ..... 232/17; 232/38; D99/30

[58] Field of Search ..... 232/17, 38; D99/30, D99/29

[56] References Cited

U.S. PATENT DOCUMENTS

| | | | |
|---|---|---|---|
| D. 256,287 | 8/1980 | McConnell | D99/30 |
| D. 296,602 | 7/1988 | Klein | D99/30 |
| 4,368,842 | 1/1983 | DeLange | 232/17 |
| 4,375,869 | 3/1983 | Hatch | 232/17 |
| 4,712,731 | 12/1987 | Gramelspacher | 232/17 |

OTHER PUBLICATIONS

Home, Mar. 1986, p. 14.

*Primary Examiner*—Robert W. Gibson, Jr.
*Attorney, Agent, or Firm*—Leo Gregory

[57] ABSTRACT

A decorative natural wood covering structure overlying an out of doors exposed mailbox.

2 Claims, 3 Drawing Sheets

MAILBOX COVER STRUCTURE

BACKGROUND OF THE INVENTION

1. Field of Invention

Relates to an overlying cover for an out of doors exposed mailbox.

2. Brief Description of the Prior Art

Particular reference is had to a post supported exposed out of door type of mailbox the use of which has been adopted by many users in suburban areas.

Out of door mailboxes are in general and for the most part made of metal and these are in specified sizes as decreed by the U.S. Postal Service. These boxes in use are not particularly attractive and do not appear to naturally blend into a rural or suburban environment. It is desirable to adapt the mailbox to better blend into a rural or suburban setting.

BRIEF SUMMARY OF THE INVENTION

It is desirable and an object hereof to provide an overlying cover for a rural type of metal or plastic mailbox to adapt it to blend more naturally into a rural or suburban setting.

It is a further object herein to provide as indicated, an overlying cover for an out of door type of mailbox, the cover being made of cedar and simulated to have the appearance of a log structure, the cedar having an appearance which readily blends into a rural or suburban setting and the wood itself being artfully designed to be naturally attractive.

It is a further object herein to provide an overlying cover for and exposed out of doors metal or plastic mailbox which endures the weather and becomes enhanced in appearance without any required maintenance.

It is still further an object herein to provide an overlying cover for an exposed out of door type of mailbox which is very simple to install.

These and other objects and advantages of the invention will be set forth in the following description made in connection with the accompanying drawings in which like reference characters refer to similar parts throughout the several views.

DESCRIPTION OF A PREFERRED EMBODIMENT

Figure 1:
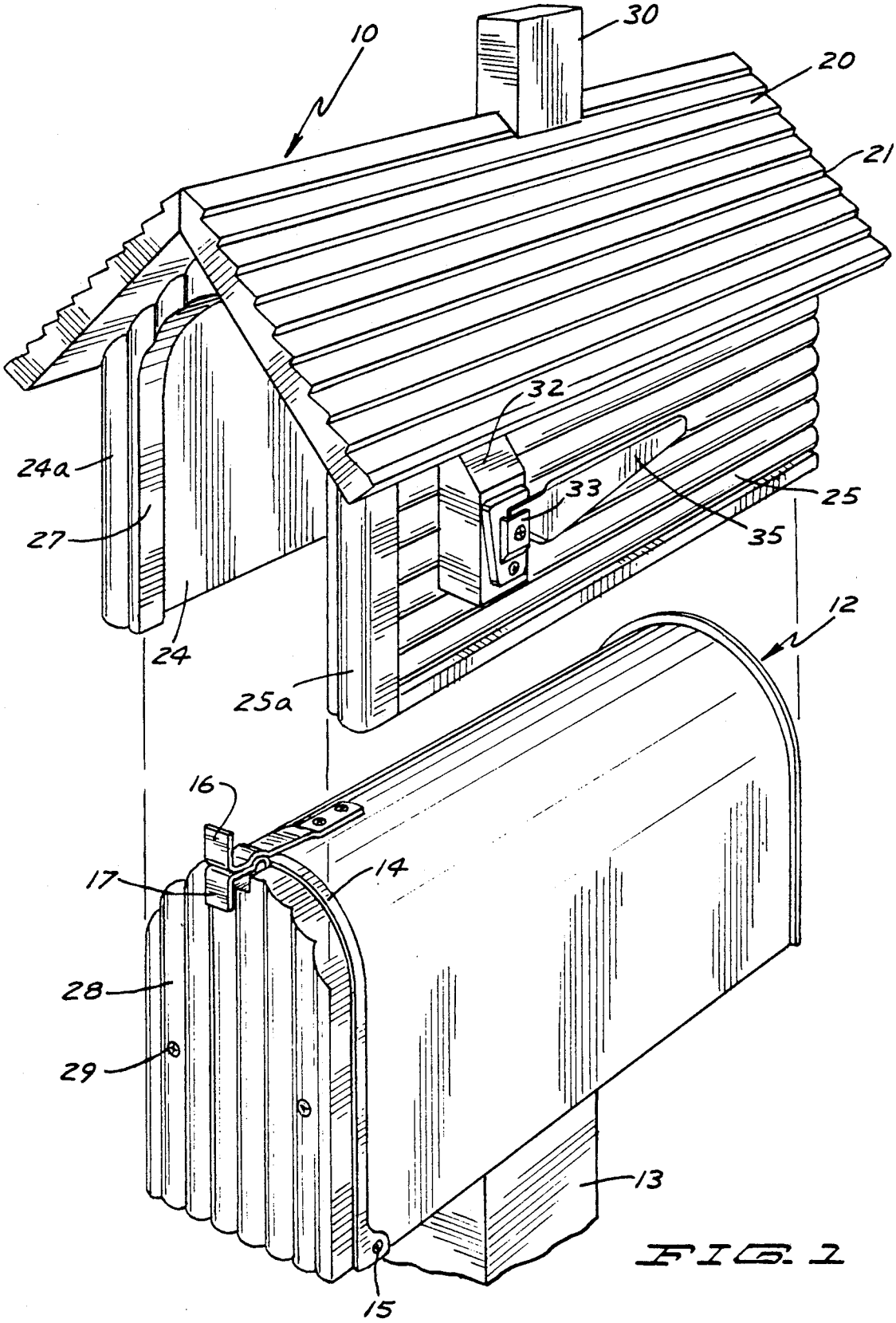
FIG. 1 is an exploded view in perspective.
Figure 2:
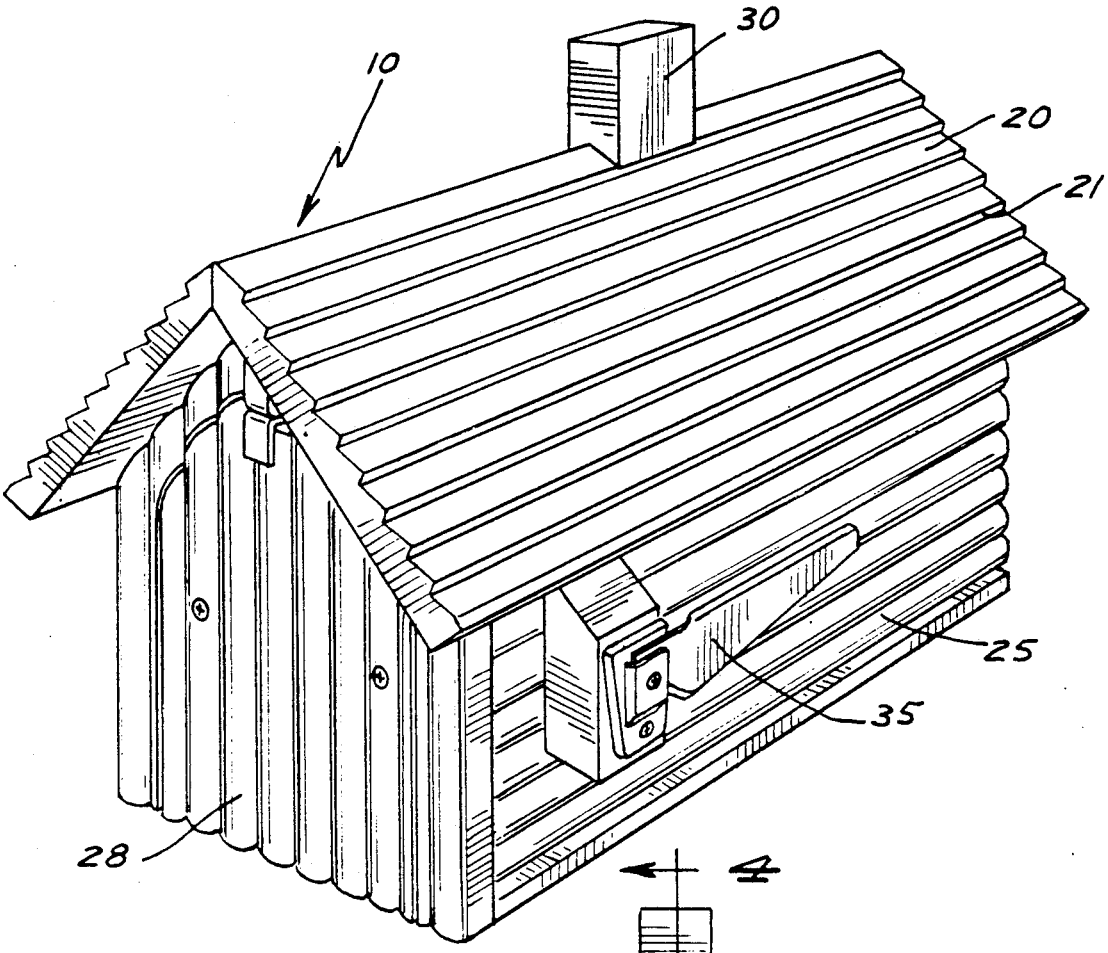
FIG. 2 is a view in perspective.
Figure 3:
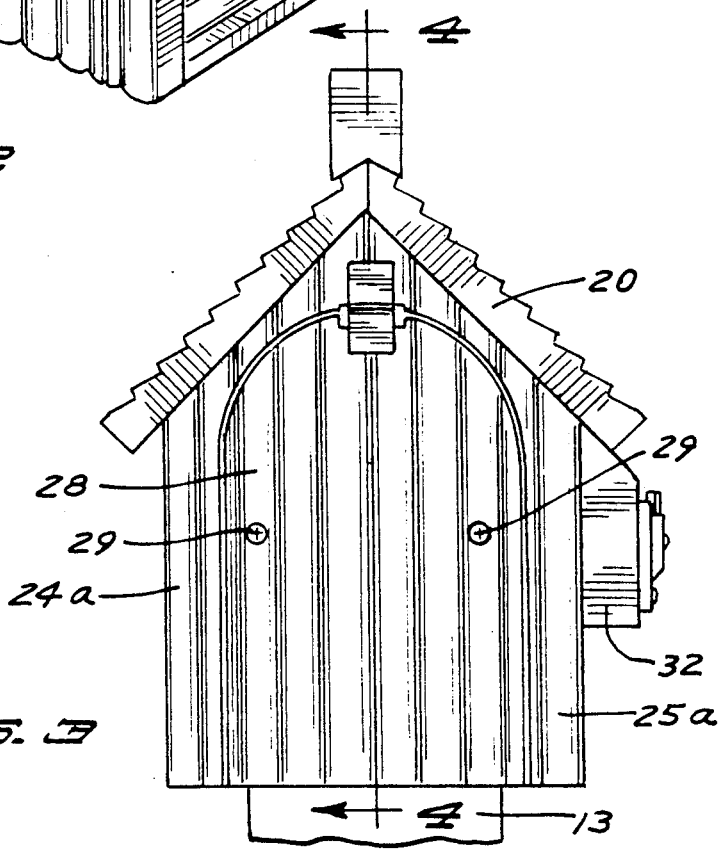
FIG. 3 is a front elevational view.

Referring to the drawings, the structure comprising the invention herein is indicated generally by the reference numeral 10.

Shown is a conventional out of door type of mailbox 12 which is in general use in rural and suburban areas, commonly mounted at a roadside location on a suitable post 13. The box as shown is generally available in metal or plastic and its size is dictated by Postal Service requirements.

Pivoted to the forward end of said mailbox 12 is a front cover or lid 14 pivoted at each side of its bottom to said box 12 as indicated at 15.

At the top of said mailbox at the front thereof is a spring plate lever type latch member 16 releasing and securing said lid 14 and carried by said lid and underlying said latch member is a downwardly curved pull member 17. Said latch and pull members are standard attachments for a mailbox such as said mailbox 10.

Provided herein to be removably disposed to overly said mailbox 12 is said structure 10 forming an open bottom shell rectangular in plan.

Said structure preferably is made of white cedar wood which improves in beauty of appearance with age and with weathering.

Said structure is shown resembling a natural wood cabin. The roof 20 is as here shown is a gable type roof having an exterior surface portion saw toothed in vertical section as at 21 to resemble cedar planks with overlaid adjacent edges. Supporting said roof are side walls 24 and 25 spaced to receive said mailbox 12 therebetween and at the rear end thereof is the rear wall 26. The leading edges of said walls are faced with trim strips 24a and 25a simulating split logs.

A front wall 27 forms a door frame to permit access into said mailbox adapted to fit into said end wall door frame is a cover 28 which is suitably secured to the outer side of the mailbox cover 14 and is shown secured by bolts 29.

Figure 4:
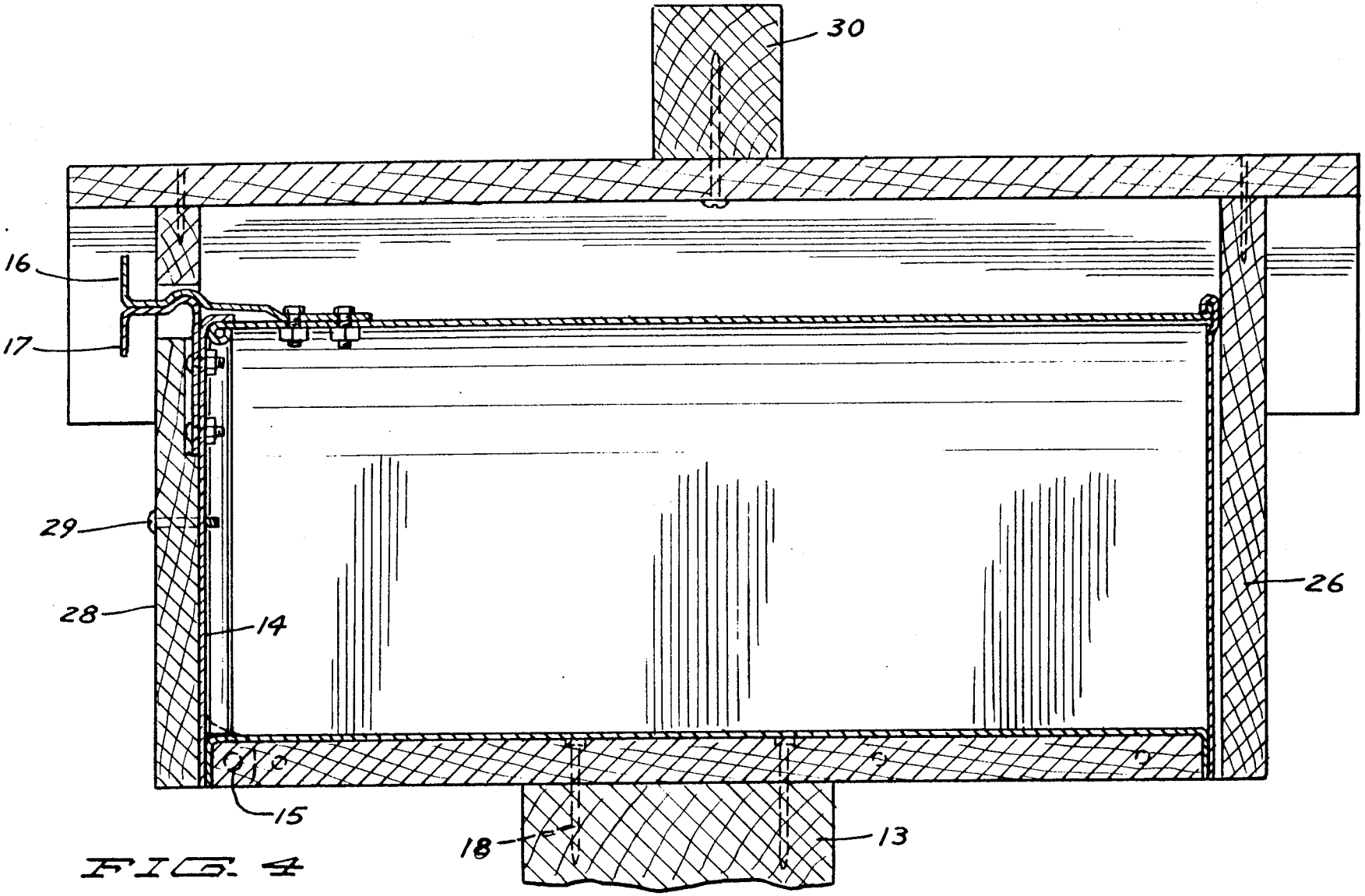
FIG. 4 is a view in vertical section taken on line 4—4 of FIG. 3 as indicated.

The side walls, the rear end wall, the front frame and the cover insert therein are formed of solid cedar boards having an exterior surface portion treatment to give the appearance of a cedar log construction and the same are conventionally secured together as by nailing as indicated in FIG. 4, as indicated at 18.

A block 30 is suitably secured to a peak portion of said roof to resemble a chimney.

Mounted upon said wall 25 is an abutment 32 onto which is secured an angled bracket 33 which has suitably pivoted thereto a tapered elongated plate member as a pointer 35 representing a flag which when raised indicates the presence of mail in said mailbox.

Said structure 10 is simply disposed upon the mailbox 12 completely overlying the same with the exception of its bottom wall. Hence the installation of the structure herein is very simple and requires only a couple of bolts or screws to secure the plate member or cover 28 to the mailbox lid or cover 14. The natural weight of said structure 10 is sufficient to assure that it will be secure in overlying said mailbox 12. The mailbox 12 commonly comes equipped with a flag such as the flag 35 and this is readily removed prior to the installation of the structure 10.

It will of course be understood that various changes may be made in form, details, arrangement and proportions of the product without departing from the scope of the invention which, generally stated, consists in a product capable of carrying out the objects above set forth, in the parts and combination of parts disclosed and defined in the appended claims.

What is claimed is:

1. A log cabin-like structure overlying an out of doors type of conventional mailbox, comprising an open bottom shell substantially rectangular in plan, spaced walls forming the sides of said shell, said walls being adapted to have their outer surface portions resemble logs, a rear end wall not unlike said side walls in appearance, a front end wall formed as a frame having its outward surface portion resembling a log structure, a roof supported by said walls, said roof having an upper surface portion saw tooth in vertical section resembling planks, an insert plate member to fit into said front end wall secured to a front cover of the underlying mailbox, a block resembling a chimney atop said roof, and a mail flag pivoted to one of said side walls, 2. A weather resistant shell adapted to overly an out of door type of mailbox, comprising a pair of side walls spaced to accommodate a conventional mailbox therebetween, an end wall enclosing one end of said shell, a wall opposite said end wall forming a frame permitting the cover of an underlying mailbox to open and close therethrough, said walls supporting a roof, a plate member fitting into said frame, means securing said plate member to said cover of said mailbox, a member resembling a chimney disposed atop said roof, means carried by said shell indicating the presence of mail in said mailbox, and said shell having an exterior adapted to resemble a cedar log construction to blend into a suburban environment.

* * * * *